US006855208B1

(12) United States Patent
Soyama

(10) Patent No.: US 6,855,208 B1
(45) Date of Patent: Feb. 15, 2005

(54) METHOD AND DEVICES FOR PEENING AND CLEANING METAL SURFACES

(75) Inventor: Hitoshi Soyama, Miyagi (JP)

(73) Assignee: Japan Science and Technology Corporation, Saitama-Ken (JP)

( * ) Notice: Subject to any disclaimer, the term of this patent is extended or adjusted under 35 U.S.C. 154(b) by 0 days.

(21) Appl. No.: 09/857,967

(22) PCT Filed: Jan. 11, 2000

(86) PCT No.: PCT/JP00/00073

§ 371 (c)(1),
(2), (4) Date: Jun. 13, 2001

(87) PCT Pub. No.: WO00/42227

PCT Pub. Date: Jul. 20, 2000

(30) Foreign Application Priority Data

Jan. 13, 1999 (JP) ..... 11-005947
Nov. 12, 1999 (JP) ..... 11-322561

(51) Int. Cl.[7] ..... B08B 7/02

(52) U.S. Cl. ..... 134/16; 134/1; 134/17; 134/19; 134/34; 134/105; 134/198; 134/200

(58) Field of Search ..... 134/1, 16, 17, 134/19, 34, 105, 198, 200; 376/305

(56) References Cited

U.S. PATENT DOCUMENTS 5,316,591 A * 5/1994 Chao et al. ..... 134/34
5,778,713 A * 7/1998 Butler et al. ..... 72/53
6,341,151 B1 * 1/2002 Enomoto et al. ..... 376/305

FOREIGN PATENT DOCUMENTS

| | | |
|---|---|---|
| JP | 6-47667 | * 2/1994 |
| JP | 7-328855 | 12/1995 |
| JP | 7-328857 | 12/1995 |
| JP | 7-328859 | * 12/1995 |
| JP | 7-328860 | 12/1995 |
| JP | 8-71919 | * 3/1996 |
| JP | 8-90418 | 4/1996 |

* cited by examiner

*Primary Examiner*—M. Kornakov
(74) *Attorney, Agent, or Firm*—Rader, Fishman & Grauer PLLC

(57) ABSTRACT

This invention relates to a metal part and other surface modification method suitable for the machining industry in which shot peening is typically used to refine the surface of a metal part (to introduce compressive residual stresses, to enhance fatigue strength, to harden the workpiece) and for fields in which parts need be cleaned. According to the present invention, workpiece W is placed within a first vessel which is filled with a fluid. The first vessel is pressurized by controlling the flow rate of the fluid flowing in the first vessel from nozzle 4 distant from said workpiece on the surface and of the fluid flowing from first vessel. Thus, the collapsing impact force of cavitation bubbles is increased so that the machined part will have its surface strengthened and cleaned by applying a peening effect to the surface of the part with said impact force.

10 Claims, 9 Drawing Sheets

FIG. 11

| MATERIAL | SURFACE BEFORE PEENING | SURFACE AFTER PEENING | HARDNESS |
|---|---|---|---|
| SKD61 | 633 | 800 | Vickers Hv |
| SKD61 | 83 | 86 | Rockwell Superficial HR 15N |
| SUP7 | 76 | 78 | Rockwell Superficial HR 15N |
| SUS304 | 55 | 57 | Rockwell Superficial HR 15N |
| Titanium | 55 | 60 | Rockwell Superficial HR 15N |
| S20C | 51 | 61 | Rockwell Superficial HR 15N |

METHOD AND DEVICES FOR PEENING AND CLEANING METAL SURFACES

FIELD OF ART

This invention relates to a method of peening metal part surfaces, such as gears, springs, and molds, and to a device in which the method is implemented. More specifically, it relates to a metal part surface modification and cleaning method and the device using this method which is especially suitable for the machining industry where shot peening is typically used to improve metal part surfaces, for example, to form compressive residual, or surface stresses, enhance fatigue strength, harden the workpiece and for use where parts need to be cleaned.

BACKGROUND OF THE ART

Conventionally, shot peening has been used to improve various metal part surfaces by forming, by example, compressive residual stresses, enhance fatigue strength, harden the workpiece.

More recently, to impede stress corrosion cracking and protect materials in critical applications, such as a nuclear reactor vessel, against such cracking, there is also a technique available to suppress the residual stresses on the surface of a workpiece using cavitation generated by injecting compressed water into water via a nozzle comprising two or more throats.

This technique to improve metal part surfaces, however, has been disclosed as using the collapsing impact force of cavitation. Nevertheless, it has been successfully used and has been confused with a "general water jet", which has a "cavitating jet" that is injected into the air.

In other words, the use of the "general water jet" has assumed that the surface peening level, for example, introduced residual stress value, improved fatigue strength level, surface hardening grade, etc. is dependent upon the pressure of the water injected. On such an assumption, an expensive high-pressure pump is employed to increase the pump discharge pressure. However, satisfactory treatment capability has remained unattainable from the viewpoint of surface treatment. Furthermore, there have been some other problems awaiting solution. The factors which may govern a cavitation collapsing impact force in the surface modification process are not yet fully understood. Additionally, neither the collapsing impact force of the cavitation bubble nor the cavitation jet's surface treatment effect have been effectively utilized.

SUMMARY OF THE INVENTION

The inventor of the disclosure specified herein has therefore proceeded with studies on the collapsing impact force of the cavitation bubble and on the cavitating jet's surface modification phenomenon. As a result, it has been verified that the collapsing impact force of the cavitation bubble and the cavitating jet's surface modification effect for example, improving residual stresses, hardening the workpiece and enhancing fatigue strength, are dependent upon not only the pressure of the pressurized water but also on the pressure of the water tank in which the workpiece is placed, that for the ratio of pressurized water pressure to water tank pressure an optimum value exists, that the cavitation collapsing impact force increases and decreases according to the temperature of the fluid, and that the cavitation collapsing impact force could be increased if the conditions referred to above were satisfied.

The present invention has been made, based on such knowledge referred to above. The workpiece to be treated is located in a tank filled with a fluid, such as water or oil. The workpiece is treated by injecting a cavitating jet. To increase the cavitating jet's treatment capability, the tank in which the workpiece is located is pressurized and the pressurization is controlled in a short time. Thus, the present invention provides a method and device for peening and cleaning metal part or other surfaces, to improve the surface of a metal part.

Furthermore, to inject a cavitating jet onto the workpiece to be treated, a freely movable pressurizing vessel is provided for peening and cleaning the surfaces of metal and other parts which are capable of treating the surface of a large-sized structure.

A pressurizing section can be placed in a pipe to inject a cavitation jet. Thus, the present invention provides a method and device for peening and cleaning the surfaces of metal and other parts, which would allow the internal surface of the pipe to be treated and cleaned while moving the section along the internal surface of the pipe.

The present invention aims to use the above-mentioned cleaning method and device to solve the problems mentioned above.

DISCLOSURE OF THE INVENTION

Accordingly, the problem-solving means employed in the present invention include a metal part and other surface modification and cleaning method, in which the part to be treated is placed within first vessel 1 which is filled with a fluid, which flows in first vessel 1 located at a distance from the surface of said part and flows from first vessel 1, with this fluid's flow rates controlled to pressurize first vessel 1 to increase the collapsing impact force of the cavitation bubble, which in turn applies a peening effect to the surface of the part to strengthen and clean the surface of the treated part.

A metal part and other surface modification and cleaning method, in which the part to be treated is placed within the first vessel 1, which is filled with a fluid, and first vessel 1 is placed within second vessel 3 which filled with a fluid to generate cavitation by injecting pressurized fluid from a nozzle distant from said part on the surface so that the collapsing impact force of the cavitation bubble may be used to strengthen and clean the surface of the treated part by applying a peening effect to the surface of the part.

A metal part and other surface modification and cleaning method, in which the first vessel 1 is pressurized by controlling the flow rates of both fluids flowing in and out of said first vessel 1 to increase the collapsing impact force of the cavitation bubbles to strengthen and clean the treated part by applying a peening effect under such impact force.

A metal part and other surface modification and cleaning method, in which a substance with different acoustic impedance is inserted between first and second vessels.

A metal part and other surface modification and cleaning method, in which the temperature of the fluid in said first vessel 1 is controlled by controlling the temperature of the fluid that fills the space between first and second vessels.

A metal part and other surface modification and cleaning method, in which the cavitating jet to be injected into first vessel 1 is sent to a cooling means from first vessel 1 and returned to a cavitating jet pump after being cooled by the cooling means.

A metal part and other surface modification device composed of the first vessel 1 capable of accommodating the part to be treated, a lid that hermetically closes the first vessel 1, the second vessel 3 capable of accommodating the first vessel 1, a nozzle to inject a pressurized fluid into the pressurized fluid, a flow control valve to control the jet pressure from the nozzle and a pressure control valve to control the fluid pressure in first vessel 1.

A metal part and other surface modification device provided with two or more said nozzles, with the second vessel 3 configured to have a depth larger than the height of the first vessel 1.

A metal part and other surface modification device, in which a substance with different acoustic impedance is arranged between said first and second vessels.

A metal part and other surface modification device whose lid on the first vessel 1 is closed with a predetermined force.

A metal part and other surface modification device provided with a means of heating or cooling the fluid in second vessel 3.

A metal part and other surface modification device, in which the part to be treated is loaded on a carriage that carries the part.

A metal part and other surface modification and cleaning method, in which first vessel 1, which is filled with a fluid, is placed on the part to be treated and the fluid flows into the first vessel 1 to pressurize first vessel 1 in the interior, with the collapsing impact force of the cavitation bubbles increased by injecting the pressurized fluid to generate cavitation in first vessel 1 which is pressurized so that the surface of the part to be treated can be strengthened and cleaned by applying a peening effect to the part under the impact force.

A metal part and other surface modification and cleaning method, in which the part to be treated is installed in first vessel 1, which is filled with a fluid, which in turn flows into first vessel 1 to pressurize first vessel 1 in the interior, with the collapsing impact force of the cavitation bubbles increased by the injection of the pressurized fluid to generate cavitation in the first vessel 1 which is pressurized so that the impact force is used to strengthen and clean the surface of the treated part by applying a peening effect to the part.

A metal part and other surface modification and cleaning device equipped with first vessel 1 placed on the part to be treated, with a nozzle to inject a pressurized fluid into first vessel 1, and with a nozzle to inject a cavitating jet into the pressurized fluid in first vessel 1 so that the collapsing impact force of the cavitation bubbles can be used to strengthen and clean the part to be treated on the surface by applying a peening effect to the surface of the part.

A metal part and other surface modification and cleaning device composed of the first vessel 1, a nozzle to introdue a pressurized fluid into first vessel 1, and a nozzle to inject a cavitating jet into the pressurized fluid in first vessel 1.

A metal part and other surface reforming and cleaning device configured to control the pressure of the fluid in first vessel 1 by a fluid pressure regulator means such as a valve or the like.

A metal part and other surface reforming and cleaning device, in which the part to be treated is immersed in the fluid in second vessel 3.

A metal part and other surface reforming and cleaning device, in which the part to be treated is placed above the surface of the fluid in second vessel 3.

A metal part and other surface modification and cleaning device provided with a means of cooling the cavitating jet fluid to be introduced into the first vessel 1.

A metal part and other surface modification and cleaning device, in which a pressurized fluid is introduced into first vessel 1 to effectively surround the cavitating jet fluid.

A metal part and other surface modification and cleaning method, in which the part to be treated, such a pipe-shaped part or conduit, has a fluid-pressurizing chamber formed in the pipe or conduct to inject a cavitating jet into such pressurized fluid and to increase the collapsing impact force of the cavitation bubbles so that the internal surface of the pipe may be strengthened and cleaned by using such impact force to apply a peening effect to the internal surface of the pipe.

A metal part and other surface modification and cleaning device equipped with first and second members to form a fluid-pressuring chamber in a pipe or conduit, with a nozzle to pour a pressurized fluid between said first and second members, and with a nozzle to inject a cavitating jet into the fluid pressurizing chamber, to strengthen and clean the surface of the treated part by using the collapsing impact force of the cavitation bubble to apply a peening effect to the surface of the part.

A metal part and other surface modification and cleaning device, in which either first and second members is provided with a fluid pressure regulator means to regulate the fluid pressure in the fluid-pressurizing chamber.

A BRIEF DESCRIPTION OF THE FIGURES

FIG. 11 depicts an example of workpiece hardening.

DETAILED DESCRIPTION OF THE INVENTION

Based on the figures, the embodiments of the present invention are described in detail below.

Figure 1:
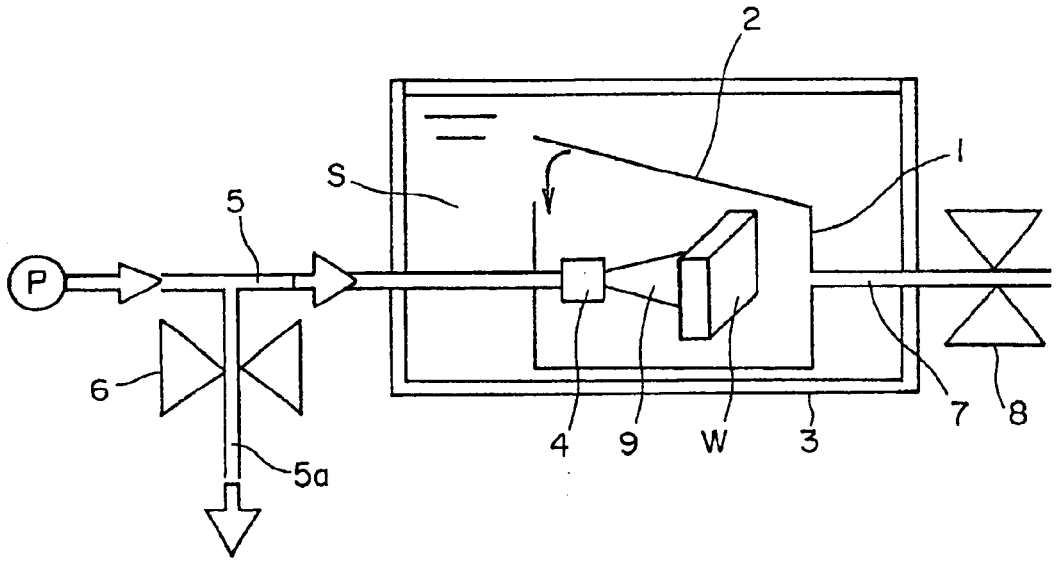
FIG. 1 is a block diagram of the surface modification device involved in a first embodiment of the present invention.

FIG. 1 is a block diagram of the metal part and other surface modification device involved in the first embodiment.

In FIG. 1, is first vessel 1, which permits a workpiece to be delivered and placed with ease, is configured to be hermetically sealable by means of lid 2, to reform the surface of the workpiece.

A second vessel 3 is capable of accommodating identical first vessel 1, and has a depth larger than the height of first vessel 1 so that it can form appropriate space S in the periphery of the first vessel 1.

Nozzle 4 injects a cavitation jet into first vessel 1.

Conduit 5 supplies the nozzle with a high-pressure fluid from first vessel 1.

Control valve 6 regulates the high-pressure fluid flow rate.

Conduit 7 is a conduit through which the fluid is drained from first vessel 1.

Pressure control valve 8 is located in the said conduct to regulate the pressure in the first vessel 1.

The first vessel 1 may be provided with two or more nozzles. It is preferable, moreover, that flow control valve 6 is located in branched conduit 5*a* rather than directly in conduit 5 to couple high-pressure pump P and nozzle 4.

Workpiece W is placed within the first vessel 1 or hermetically sealed with the first vessel 1 which is filled with a fluid, such as water or oil, allowing the workpiece to be delivered and entered, with the space between the first vessels 1 and the second vessel 3 being filled with a fluid, such as water or oil.

The flow control valve 6, pressure control valve 8 and pump P are coupled with an electronic control device which is not illustrated. They are also controlled to attain an optimum pressure, based on a signal from a pressure/temperature sensor which is not illustrated.

Specific Action (Operation) in the Embodiment Forms:

After being placed within first vessel 1, workpiece W is hermetically sealed with Lid 2 capable of being peened and closed. High-pressure water is injected from nozzle 4 to generate cavitation 9 around the jet so the cavitation bubbles hit against workpiece W. The collapsing impact force of the cavitation bubbles acts upon the surface of the workpiece, thereby bringing about a workpiece-hardening effect to the surface of the workpiece, an improvement of residual stresses and an enhancement of fatigue strength.

To increase the collapsing impact force of cavitation bubbles 9, flow control valve 6 is used to control the flow rate of the pressurized fluid flowing into first vessel 1 from nozzle 4 or pressure control valve 8 is used to control the flow rate of the fluid flowing from first vessel 1 to control the pressure of the fluid pressurized in first vessel 1.

If the first vessel 1 has any portion in gaseous phase, moreover, pressurization will require a certain time because the gaseous-phase portion is compressed with the pressurized water. In this embodiment, second vessel 3 has its depth increased so that first vessel 1 can be pressurized in a shorter time. And the pressure of the fluid filled in second vessel 3 is used to keep a specified pressure applied to first vessel 1. This permits first vessel 1 to be pressurized in a shorter time while allowing the gaseous phrase portion in first vessel 1 to be reduced to the minimum possible in a short time.

As referred to above, the present invention is capable of minimizing the gaseous phase portion in first vessel 1 to be pressurized. Consequently, it is possible to reduce the time required to pressurize first vessel 1.

In a case in which first vessel 1 has an optimum fluid pressure of 5 atmospheres, for example, it is assumed that first vessel 1 contains approximately 12 liters of air. Then, approximately 1 minute is required to pressurize the vessel by means of a high-pressure pump having a capacity of 10 liters per minute. Consequently, the time equivalent to the actual working time (several seconds through several minutes, which could be reduced, depending upon the arrangement of the nozzle), would be wasted. With the present invention, first vessel 1 is immersed beforehand in the fluid filling second vessel 3. The air in first vessel 1, therefore, can be reduced to one-tenth or less while enabling a reduction of treatment time to one-tenth or less. Furthermore, in proportion to the depth of first vessel 1, a specified pressure is kept applied to first vessel 1. In the above-mentioned case, for example, it is possible to reduce the pressurizing time by 100% because the pressurization would take zero time when second vessel 3 has a water depth of 50 meters even if approximately 12 litters of air is stored in first vessel 1.

In comparison with the case where first vessel 1 is not pressurized as referred to above, the present embodiment allows for a successful achievement of desirable effects, such as a significant improvement of residual stresses, an enhancement of fatigue strength, a capability of inserting compressive residual stresses into the deep portion from the workpiece surface, higher efficiency (shorter time requirement), than the case without pressurization, together with the capability of hardening the surface of the workpiece.

Figure 3:
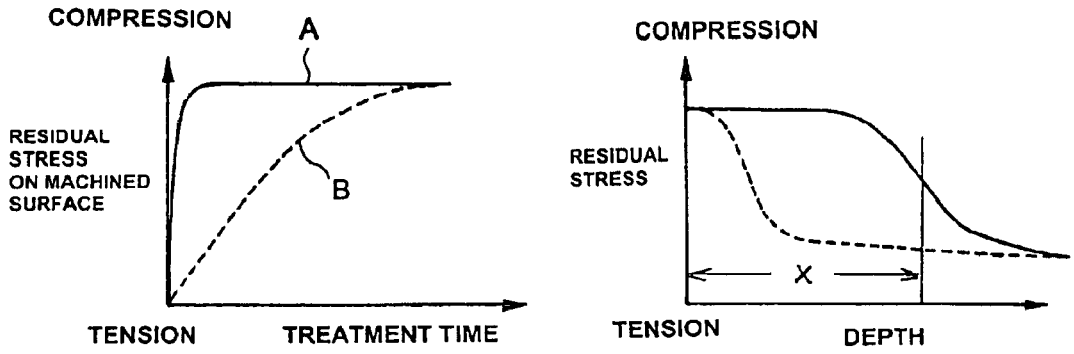
FIG. 3 shows the pressurization data relating to the present invention.

FIG. 3 shows the pressurization data. In the figure, A shows the case with pressurization and B without pressurization while X stands for the depth at which residual stresses may be improved. Compared with the case without pressurization, the depth in which compressive residual stresses penetrate the surface of the workpiece is increased twice through 10 times or more with pressurization while the treatment time requirement is decreased by half through one-tenth. This value is attainable when the jet has a discharge pressure of 20 MPa, with a nozzle bore ranging from 0.4 to 0.8 millimeters. The larger the nozzle and the greater the discharge pressure, the more conspicuously effective the pressurization will be.

The collapsing impact force of the cavitation bubbles is also dependent upon the fluid temperature. With second vessel 3 located in the periphery of first vessel 1, and with a fluid temperature control unit added to second vessel 3, the fluid in first vessel 1 can be kept at a constant temperature and controlled to a range of 30 to 60°, within which the cavitation bubbles come to have an optimum collapsing impact force. Unless second vessel 3 is provided, first vessel 1 will have a temperature rise, thereby damping the collapsing impact force of cavitation bubbles. At the same time, there are such hazardous possibilities that leakage may take place in the high-pressure pump, piping and/or first vessel 1, or may turn liable to break.

With water applied, cavitation bubbles have a collapsing impact force maximized at a temperature of 50°, intermediate between the boiling and melting points. In practical use, it would be hazardous if a high-pressure pump or piping had a high temperature (80° or more) at which their resistance to pressure would show an extreme drop. In this sense, first vessel 1 should preferably have a fluid temperature fall within a range of 30 through 60°.

Installing second vessel 3 allows for a reduction of the cavitation noise that takes place within first vessel 1. Inserting a substance with different acoustic impedance between the first and second vessels will enhance the reduction is noise effect.

With second vessel 3 installed, it is possible to eliminate the gaseous-phase portion, compressed gas, in first vessel 1 as much as possible. Even if leakage should take place from first vessel 1, it will be safe because the pressure in first vessel 1 instantaneously attenuates for few compressed portions exist and the fluid in first vessel 1 is non-compressive even if it leaks. If a gaseous phase portion should exist in first vessel 1, it is hazardous because the portion will inflate, thereby letting the fluid continue jetting out through the leaking point.

Cavitation bubbles have a collapsing impact force dependent upon the air content of the fluid in first vessel 1, too. If the fluid in first vessel 1 should have its air content increased as a result of exposure to the atmosphere, the cavitation bubbles will have its collapsing impact force attenuated. In other words, the treatment capability of the cavitating jet will be decreased. Installing second vessel 3, however, prevents the fluid in first vessel 1 from being exposed directly to the atmosphere. As a result, the fluid in first vessel 1 has its air content scarcely changed so that the cavitating jet can maintain nearly constant treatment capability.

Subsequently, the second embodiment of the present invention will be described, based on the figures.

Figure 2:
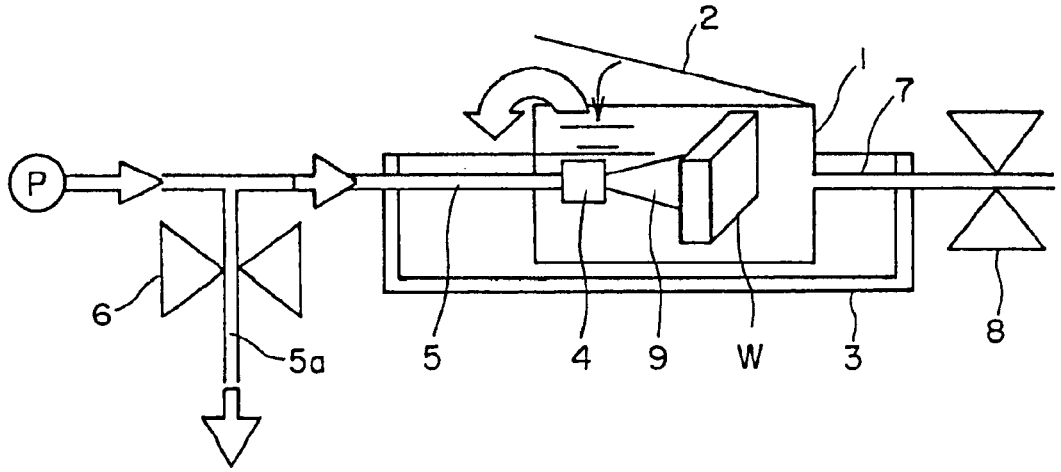
FIG. 2 is a block diagram of the surface modification device involved in a second embodiment of the present invention.

FIG. 2 is a block diagram of the metal part and other surface modification device involved in the second embodiment.

The device in the second embodiment has a shallower second vessel 3 than that in the first embodiment. And the second embodiment is configured so that the fluid will overflow at the upper edge of first vessel 1 while allowing the treatment to be performed just like the first embodiment.

In the second embodiment, it is necessary to pressurize first vessel 1 in the interior. Similarly to the first embodiment, therefore, the second embodiment should have lid 2 closed so that the fluid may overflow through the clearance of lid 2. If a weight is placed on lid 1 of first vessel 1, or a spring with a specified spring constant is used to couple the lid with the vessel, a resistance can be applied to the opening of the lid to mechanically pressurize first vessel 1. This applied pressure is controllable using an electronic controller or the like.

Figure 4:
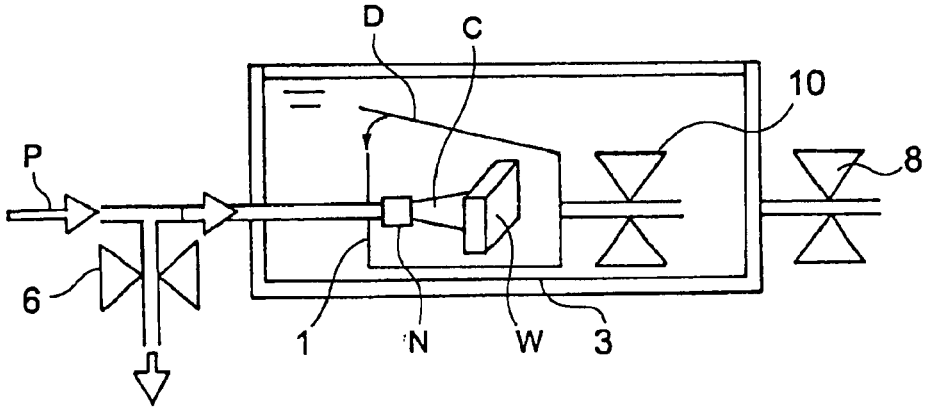
FIG. 4 is a block diagram of the surface modification device involved in a third embodiment of the present invention.

A third embodiment of the present invention, will be described while referring to FIG. 4. In the figure, P is a fluid from the high-pressure pump, C a cavitating jet, D a lid to hermetically seal after inserting the workpiece, N a nozzle, W a workpiece and 6 and 10 flow control valves.

The third embodiment differs from the first and second embodiments in the method of draining the fluid from first vessel 1. In other words, the third embodiment has the fluid discharged into second vessel 3 by way of flow control valve 10. In addition, the fluid in second vessel 3 is drained from second vessel 3 to the exterior by way of flow control valve 8. This configuration allows for an effective elimination of residual bubbles within first vessel 1 after cavitation forms have collapsed.

Subsequently, embodiments 4 through 6 will be described, based on the figures. Embodiments 1 through 3 referred to above need to have the workpiece entirely placed within a hermetically sealable vessel filled with a fluid, such as water or the like. It is necessary, therefore, to provide first vessel 1, which is larger than the workpiece. It is difficult, therefore, to treat the surface of a long workpiece. Additionally, embodiments 1 through 3 could not be applied to structures such as a floor, a road, a bridge, and the like. In addition, they involve the problem of inability to treat the surface in the interior of a pipe or to clean the internal surface of the pipe.

Embodiments 4, 5 and 6, therefore, are described herein. Embodiments 4 and 5 allow for the hardening of the surface of the workpiece, to improve residual stresses and to enhance fatigue strength, with the collapsing impact force of the cavitation bubbles acting on the workpiece surface similarly to the above-mentioned embodiments even if the first vessel 1 to be pressurized is smaller than the workpiece. In addition, a description will be given about embodiment 6, which permits the internal surface of a pipe to be treated.

Figure 5:
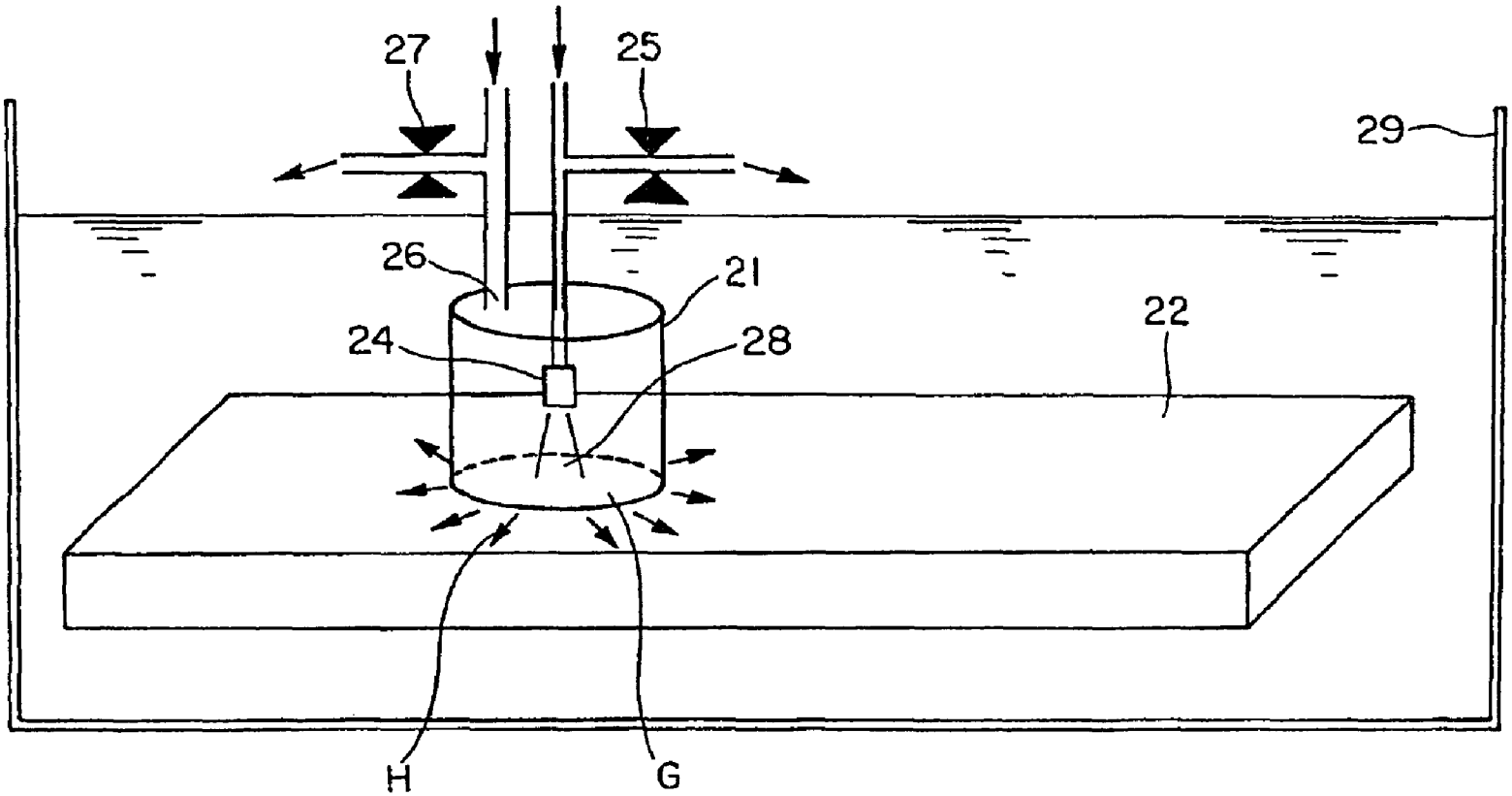
FIG. 5 is a block diagram of the surface modification device involved in fourth embodiment of the present invention.
Figure 6:
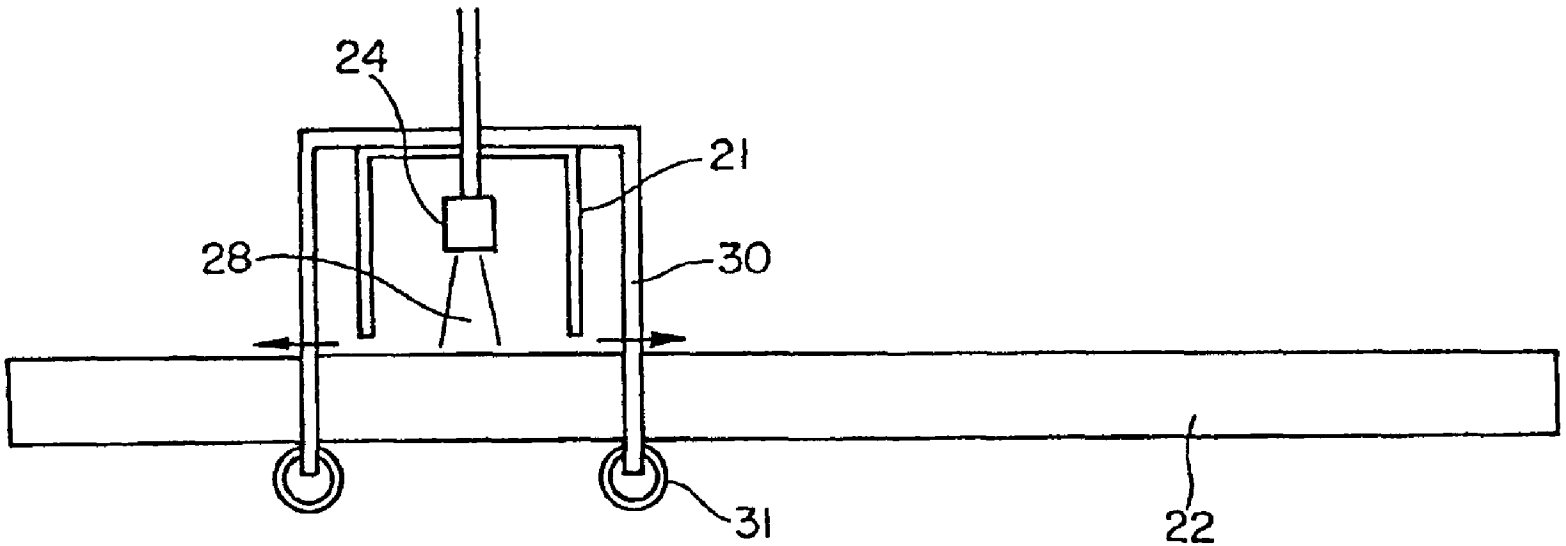
FIG. 6 illustrates the method of pressing a workpiece against first vessel 1 in FIG. 5.

FIG. 5 depicts embodiment 4 of the present invention. FIG. 6 is an extended block diagram of first vessel 21 in embodiment 4.

In FIG. 5, 21 is the first vessel 21 to improve the surface of the workpiece. It is configured to have a size large enough to partially cover the surface of workpiece 22 as illustrated. First vessel 21 is supported with leg members 30, at the lower part of which rollers 31 and others are arranged as shown in FIG. 6 so that first vessel 21 can move onto workpiece 22. leg members 30 are provided to straddle workpiece 22. Inside the first vessel 21, injection nozzle 24 is arranged to inject cavitating jet 28 into the vessel. The flowing path that communicates with nozzle 24 is provided with flow control valve 25. To move a high-pressure fluid into the first vessel 21, nozzle 26 is arranged inside the vessel. The flowing path that communicates with nozzle 26 is provided with pressure control valve 27. The first vessel 21 is provided with pumps which are not illustrated (centrifuigal pump, vortex pump, etc.) to move a high-pressure fluid (pressure 0.1 through 10 kg/cm2) into first vessel 21. This permits the vessel to maintain a predetermined pressure. In the figure, H stands for a flow leaking from first vessel 21, G for the portion at which first vessel 21 has a surface blank, and a second vessel 29 that permits the workpiece to be delivered and enter freely.

In this instance, leg member 30 with roller 31 is configured to support first vessel 21. It is possible, however, to provide first vessel 21 at the lower part directly with roller 31 movable over workpiece 22. In either case, an appropriate clearance control means, for example magnet or the like, is provided to prevent the surface of workpiece 22 and first vessel 21 from opening too much, with first vessel 21 afloat due to an action of the high pressure liquid entering into the vessel. It is possible, furthermore, to insert an elastic material, such as spring or the like, between leg member 30 and first vessel 21 so that first vessel 21 can be braced on the workpiece side.

Embodiment 4 referred to above has the action described below.

Workpiece 22 is arranged in the fluid in the second vessel 29 and first vessel 21 is placed onto the surface of workpiece 22. Under this condition, a pressurizing fluid is introduced into first vessel 21 and cavitating jet 28 is injected from nozzle 24 into 21 or second vessel 31 to generate cavitation around the jet so that cavitation bubbles will strike workpiece 22. In this stage, the fluid pressure in first vessel 21 and the pressure in cavitating jet 28 are controlled, respectively, with pressure control valve 27 and with flow control valve 25. The collapsing impact force of the cavitation bubbles act on the surfaces of the workpiece to bring about a hardening effect on the workpiece surface, an improvement of residual stresses and an enhancement of fatigue strength. The used fluid is discharged to the exterior through gaps between first vessel 21 and the workpiece.

In this embodiment, cavitating jet 28 is generated in the pressurized fluid inside the small-sized first vessel 21, which is placed on workpiece 22 which is immersed in the fluid inside second vessel 29 to partially treat the workpiece. Consequently, it is possible to minimize that portion of first vessel 21, which should be pressurized, so that the time required to pressurize first vessel 21 can be reduced to the minimum possible. Since portions of the workpiece are partially treated sequentially, it is also possible to treat even a large-sized workpiece with ease.

In this embodiment, the fluid will leak between the first vessel 21 and workpiece 22. It is necessary, therefore, to pour in a larger quantity of the pressurizing fluid than such leakage, with a pump other than the high-pressure one. Since introducing the fluid through the pump for such pressurization is not required to generate cavitation, an applicable pump may have a relatively low discharge pressure (discharge pressure 0.1 through 10 kg/cm2, or lower by 1/100 through 1/50 of the discharge pressure for a cavitating jet pump). Since a certain level of flow rate is required, however, it is preferred to employ a different type of pump (centrifugal pump, vortex pump, etc.) than a cavitating jet pump (generally a plunger pump, approximately 10 through 1,000 kilograms per square centimeter). Usually, a cavitating jet pump has a flow rate of several liters per minute through several ten liters per minute. It is difficult, therefore, to compensate for all the flow leaked from first vessel 21 pressed against the surface of the workpiece. A high-pressure fluid of a relatively low-pressure type other than the high pressure cavitating jet is introduced into first vessel 21.

As referred to above, this embodiment has a significant feature in the sense that the interior of first vessel 21 is pressurized by introducing a high-pressure fluid, other than the cavitating jet high-pressure fluid, into small sized first vessel 21. The fluid pressure in first vessel 21, is also controllable by controlling the opening/closing valve attached to the vessel. Next, embodiment 5 is described while referring to FIG. 7.

Figure 7:
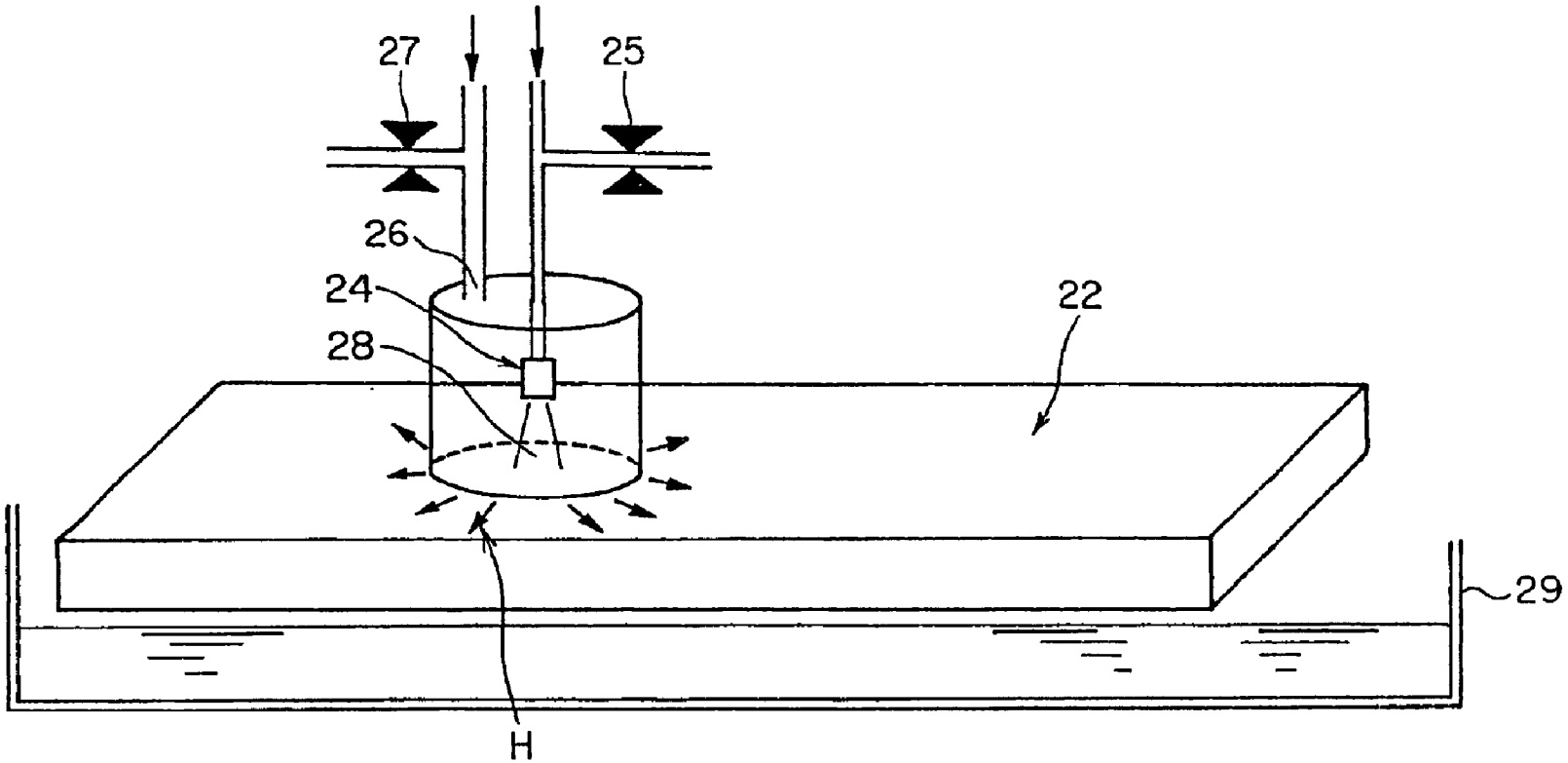
FIG. 7 is a block diagram of the surface modification device involved in a fifth embodiment of the present invention.

Embodiment 5 is the case where workpiece 22 is arranged above the fluid surface without being immersed into the fluid in second vessel 29. In this instance, the configuration is similar to that in Embodiment 4, except that second vessel 29 has a water level lower than the surface of the workpiece. Included in this embodiment is that first vessel 21 is only arranged on the surface of the workpiece, with the second vessel 29 eliminated. In FIG. 7, furthermore, H stands for the flow of the leak from the first vessel 21.

Embodiments 4 and 5 above, are also applicable to the workpiece loaded on a carriage means, such as a conveyor belt or the like. For example, the workpiece is placed upon and moved to the bottom of the first vessel 21 by means of such carriage means. With the carriage means subsequently stopped, first vessel 21 is moved down to accommodate the workpiece in the interior. Under this condition, a cavitating high-pressure fluid jet is introduced into first vessel 21 so that the workpiece on the carriage means can be treated and cleaned similarly to each of the embodiments referred to above.

Embodiment 6 is now described.

Embodiment 6 is the case where the internal surface of a conduit formed in a pipe or a member is treated. In this instance, member No. 1 (first plug) and member No. 2 (second plug) are provided inside a pipe or conduit to treat the surface of the conduit between these two members.

Figure 8:
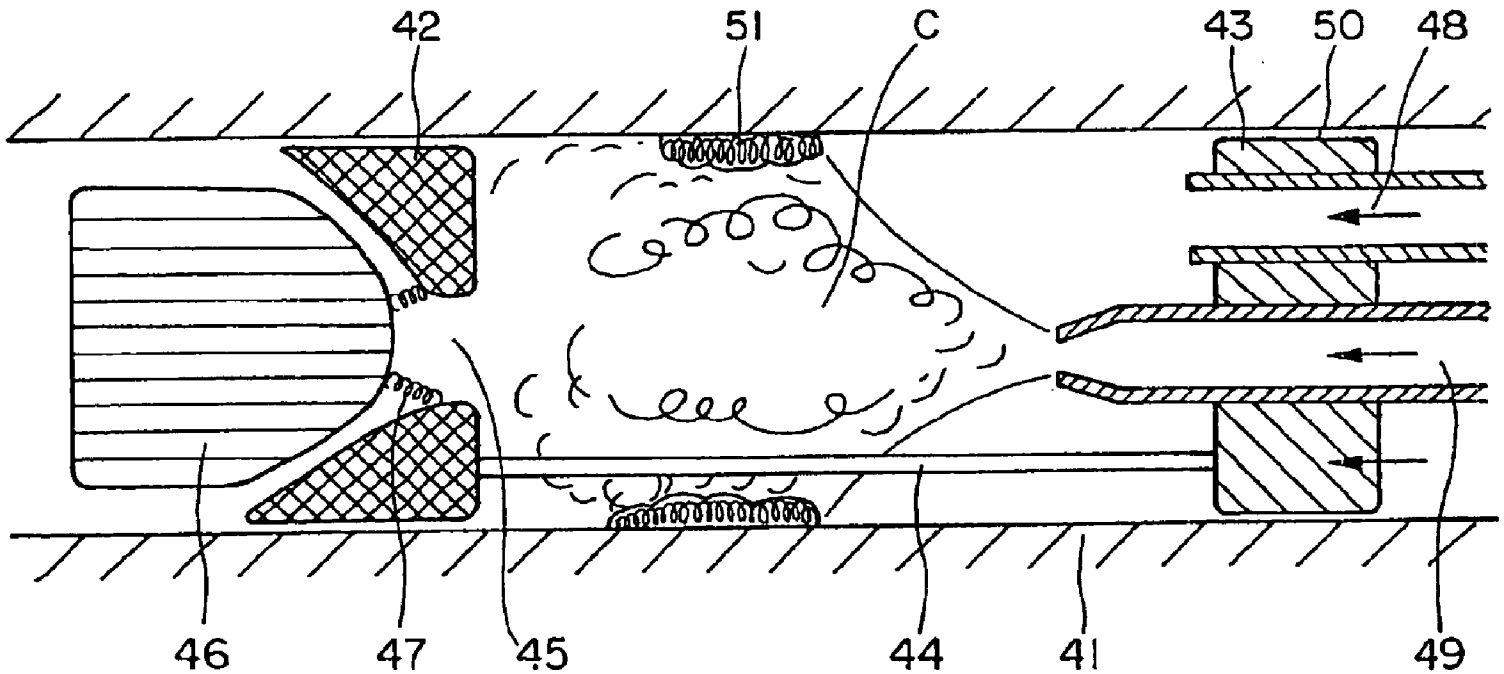
FIG. 8 is a block diagram of the surface modification device involved in a sixth embodiment of the present invention.

In FIG. 8, 41 is the pipe or workpiece. Inside this pipe 41, first plug 42 and second plug 43 are arranged at predetermined intervals by means of connecting rod 44.

First plug 42 is slideable and sealed tightly on the internal surface of the pipe against leakage. On this first plug 42, fluid drain port 45 is formed and provided with valve 46 capable of closing the port. Valve 46 is pressed against port 45 by the bracing force of spring 47 or the like as illustrated. Once the fluid pressure in the interior has exceeded a specified level, the high-pressure fluid is discharged through port 45. For valve formation, the valve of another form is usable as far as it is functioning identically.

Second plug 43, furthermore, holds pipe 48 to introduce a pressurized fluid into the piping, and pipe 49 to introduce a high-pressure fluid for cavitation jet C. Second plug 43 is arranged to have a slight clearance 50 against the internal surface of the pipe in the surroundings. Pipes 48 and 49 are provided with pressure and flow control valves similarly to the embodiment forms referred to above so that the fluid pressure supplied from each pipe can be regulated. In the figure, 51 is the debris or pariculates attached to the pipe on the internal surface.

In this embodiment, first plug 42 and second plug 43, coupled by means of a connecting rod in the pipe, are arranged as illustrated to introduce an intra-pipe pressurization fluid between plugs 42 and 43. While keeping both plugs at a specified fluid pressure, the high-pressure fluid for cavitating jet C is introduced to clean the interior of the pipe. With the cavitating jet striking the pipe on the internal surface, it is possible to treat the surface on the internal surface of the pipe. In the treatment process, the fluid between first plug 42 and second plug 43 is discharged together with debris through gap 50 between second plug 43 and pipe 41. Thus, first plug 42 and second plug 43 have their positions gradually moved by an appropriate means so that the pipe can be cleaned and surface-treated on the entire internal surface of the pipe. The fluid pressure between first plug 42 and second plug 43, may be controlled by opening and closing those valves which are provided in either plug.

In this embodiment, moreover, first and second plugs are coupled by means of connecting rod 44. Nevertheless, a connecting string or the like may also be employed in the place of the connecting rod. In some circumstances, first and second plugs may not need to be coupled by means of a rod or string. In this case, it is necessary to fasten first and second plugs inside the pipe by some appropriate fastening means, such as friction or the like so that either plug will not move over the internal surface of the pipe due to the action of the high-pressure fluid during the treatment.

Figure 9:
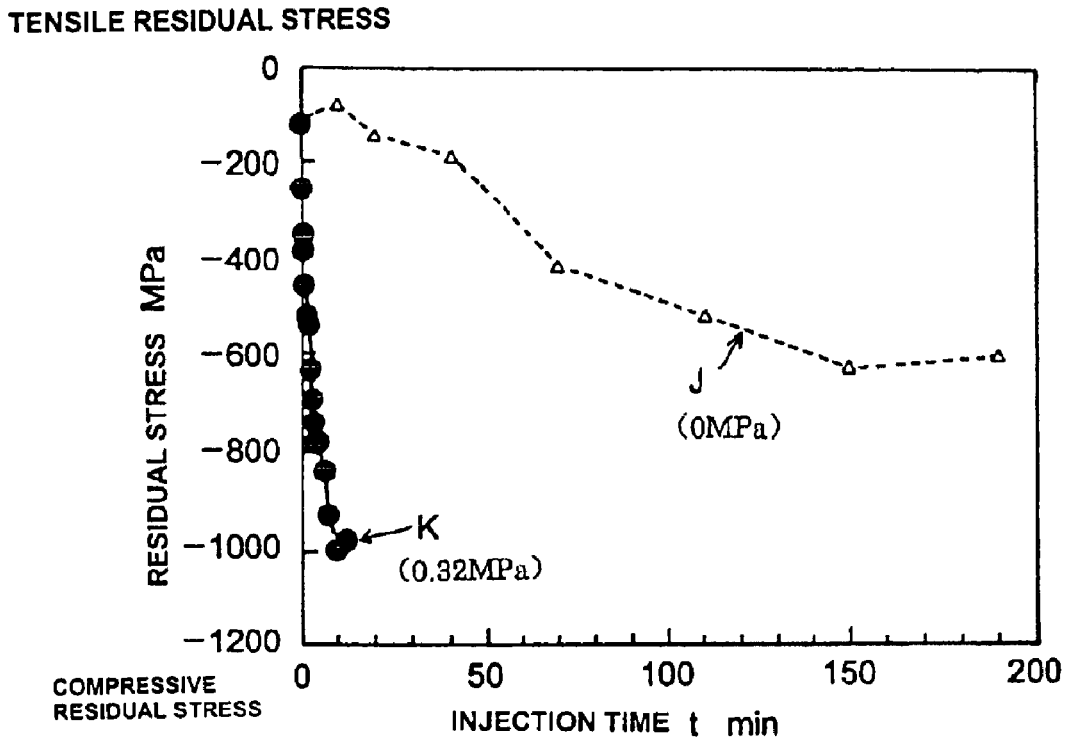
FIG. 9 shows the compressive residual stresses formed from the treatment of an alloy steel tool using the present invention.

FIG. 9 shows the compressive residual stresses that are the result of treating with compressive residual stresses introduced into the tool alloy steel (forging die material) employed in the present invention. In FIG. 9, the material is SKD61, the nozzle diameter is 2 millimeters and the injection pressure is 30 MPa. With first vessel 21 pressurized (K in the figure), an enhancing treatment can be completed in 10 minutes. Without pressurizing the vessel (J in the figure), 150 minutes are required while compressive residual stresses remain at a level of approximately 60%.

Figure 10:
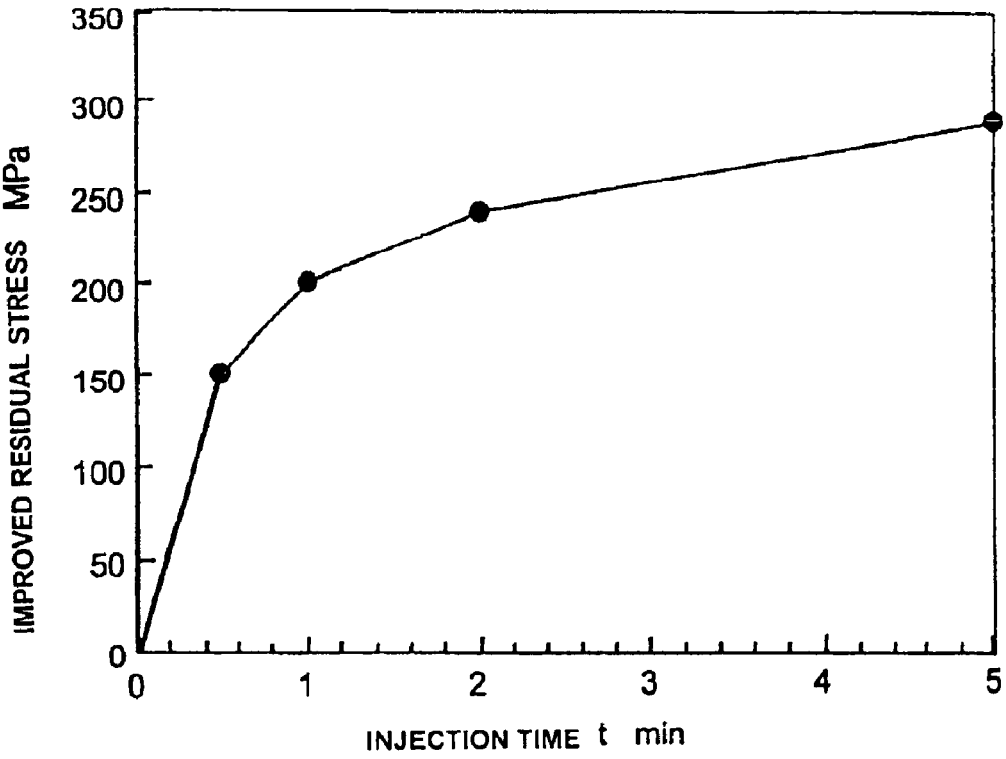
FIG. 10 shows the compressive residual stresses formed from the treatment of a carburized gear material using the present invention.

FIG. 10 depicts the compressive residual stresses that are the result of treating with compressive residual stresses introduced to carburized gear material employed in the present invention. In FIG. 10, the nozzle has a diameter of 2 millimeters, an injection pressure of 30 MPa and a pressurizing pressure 0.32 MPa.

FIG. 11 shows an example comparing the workpiece hardening, with a nozzle diameter of 2 millimeters, an injection pressure of 30 MPa and treatment pressure 0.32 MPa.

As referred to above, embodiment 5 requires the pressurizing of a first vessel 21 smaller than that of the workpiece. Even the surface of a long steel plate, a large-sized die or the like, which cannot be placed within first vessel 21, can be treated with ease. Moreover, the present process, is applicable to floor cleaning by a cavitating jet. Additionally, the pressurizing water to be poured into first vessel 21 may be provided separately from the pressurizing water for the cavitating jet so that the equipment can be set up at a lower cost without the necessity of providing a large-capacity plunger pump.

In Embodiment 6, it is also possible to readily treat and clean the internal surface of a pipe, with a pressurizing section formed inside the pipe.

Described above are a variety of embodiment forms involved in the present invention. Nevertheless, flow control valves, pressure valves and the like are available in either automatic or manual control types. For fluid, either water or oil and the like are applicable. In each embodiment referred to above, the fluid may have its temperature rise excessively because the motor power may change into heat through a cavitating jet when it is introduced into first vessel 21. In this case, the pressure in first vessel 21 is utilized to cool down the fluid in first vessel 21 by sending the fluid to various cooling means known to the public other than first vessel 21. Later, it is possible to re-supply the pump with the fluid again. If such a technique of feeding the fluid pressure in first vessel 21 to another cooling means is employed, it is unnecessary to provide a new pump to send the fluid in first vessel 21 to the cooling means so that the fluid can be readily cooled down in reality.

To introduce the cavitating jet and pressurizing fluid into first vessel 21, it is possible to arrange both cavitation jet nozzle and pressurizing water nozzle adjacently in each of the embodiments referred to above. In addition, a cavitating jet nozzle may be located at the center of the vessel and the pressurizing water nozzles may be arranged to surround the former so that the cavitation jet can strike the workpiece as if it were surrounded by the pressurizing water.

In addition, it is possible to change the positional relationship between the cavitation jet nozzle and pressuring water nozzle to another form as required. It is possible, as might be required, to freely set the arrangement of the workpiece, based on its shape. As an example, it is possible to form the nozzle itself as an integral part of the vessel.

The present invention may also be embodied in any other forms without departing from its spirits and/or principal features. In this sense, the embodiments referred to above are given for the purpose of example and must by no means be interpreted in any restrictive sense.

INDUSTRIAL USABILITY

With the prevent invention as described in detail above, the workpiece is placed within first vessel 21, which is in turn hermetically scaled. Then, a high-pressure fluid is injected from a nozzle to generate the cavitation around the jet to strike cavitation bubbles against the workpiece. Consequently, the collapsing impact force of the cavitation bubbles act on the workpiece, thereby bringing about the surface modification and cleaning effects, such as workpiece hardening, residual stress improvement, fatigue strength enhancement and so on. In a case in which a method of placing first vessel 21 on the workpiece is employed, it is also possible to improve the surface of a long steel plate, a large-sized die and the like. In addition, it is also applicable for cleaning the floor by a cavitating jet. Forming a pressurizing section in a pipe or conduct, will also permit the internal surface of the pipe to be treated and cleaned. If the pressurized water introduced into first vessel 21 is provided apart from the cavitating jet pressurizing water, it is also possible to set up the equipment at a lower cost without the necessity of a large-flow plunger pump. Such excellent effects as referred to above could be brought about by the present invention.

What is claimed is:

1. A metal part and other surface modification and cleaning method, comprising the steps of placing the part within a first vessel, wherein the first vessel is filled with a first fluid, placing said first vessel within a second vessel, wherein the second vessel is filled with a second fluid, generating cavitation by injecting pressurized first fluid from a nozzle separated from said part surface in said first vessel so that the collapsing impact force of bubbles formed from the cavitation strengthens and cleans the surface of the treated part by applying a peening effect to the surface of the part; and further comprising the step of inserting a substance with a different acoustic impedance between said first and second vessels.

2. The metal part and other surface modification and cleaning method according to claim 1, further comprising the step of controlling input flow rate of the first fluid into the first vessel and an output flow rate of the first fluid from the first vessel to pressurize the first vessel, wherein the collapsing impact force of the cavitation bubbles is increased and strengthens and cleans the treated part by applying a peening effect under such impact force.

3. The metal part and other surface modification and cleaning method according to claim 1, further comprising the step of controlling the temperature of the first fluid in said first vessel by controlling the temperature of the second fluid that fills the space between said first and second vessels.

4. A metal part and other surface modification device comprising: a first vessel, said first vessel having an opening that receives the part and a first fluid; a lid, said lid being hermetically sealable enclosing the first vessel; a second vessel, said second vessel having an opening that receives the first vessel and a second fluid; a nozzle that injects pressurized first fluid into the first pressurized fluid contained in the first vessel; a flow rate control valve that controls jet pressure from said nozzle; a pressure control valve that controls the fluid pressure in the first vessel; and a substance with a different acoustic impedance between said first and second vessels.

5. A metal part and other surface reforming device according to claim 4 above, in which two or more said nozzles are provided.

6. A metal part and other surface modification device according to claim 4, wherein said second vessel has a larger depth than the height of the first vessel.

7. A metal part and other surface modification device according to claim 4, wherein the lid on said first vessel is closed with a predetermined force.

8. A meal part and other surface modification device according to claim 4, further comprising a means of heating or cooling the second fluid in said second vessel.

9. A metal part and other surface modification device according to claim 4, further comprising a carriage means that carries said part to be treated.

10. A metal part and other surface modification and cleaning device according to claim 4, further comprising a means of cooling the first fluid.

* * * * *